United States Patent [19]

Dixon et al.

[11] Patent Number: 4,560,031

[45] Date of Patent: Dec. 24, 1985

[54] HEIGHT ADJUSTABLE APPARATUS

[76] Inventors: Paul L. Dixon, 6 Ravensbourne Rd.; Seymour C. Daniels, 12 Glenwood Rd., both of Catford, London, SE6, England

[21] Appl. No.: 731,267

[22] Filed: May 7, 1985

[30] Foreign Application Priority Data

May 22, 1984 [GB] United Kingdom ..... 8413056
Aug. 3, 1984 [GB] United Kingdom ..... 8419879

[51] Int. Cl.[4] ..... E04G 21/14

[52] U.S. Cl. ..... 182/129; 182/97; 182/115; 414/11

[58] Field of Search ..... 182/129, 115, 116, 97, 182/39, 36, 151; 414/11

[56] References Cited

U.S. PATENT DOCUMENTS

| | | | |
|---|---|---|---|
| 317,325 | 5/1885 | Elliott | 182/115 |
| 1,082,240 | 12/1913 | Rowley | 182/129 |
| 1,606,101 | 11/1926 | Russell | 414/11 |
| 1,974,572 | 9/1934 | Laflin | 182/39 |
| 2,405,453 | 8/1946 | Savage | 182/97 |
| 2,964,293 | 12/1960 | Foth | 414/11 |
| 2,966,993 | 1/1961 | Cooper | 414/11 |
| 3,089,599 | 5/1963 | Casella | 182/129 |
| 3,208,555 | 9/1965 | Fry | 182/129 |
| 3,314,553 | 4/1967 | Vircks | 414/11 |

*Primary Examiner*—Reinaldo P. Machado
*Attorney, Agent, or Firm*—Roylance, Abrams, Berdo & Goodman

[57] ABSTRACT

Height adjustable apparatus (2) for supporting goods for a person at a desired height, which apparatus (2) comprises a base (4), a single elongate support member (6) which upstands from the base, a platform member (8) which is provided on the support member at the end of the support member remote from the base, and a ladder (10) which is secured to the support member and which affords access to the platform member, the support member being adjustable in length so that the height of the platform member above the base can be varied to that required by a person for a particular task being undertaken, the ladder being so secured to the support member that the support member is adjustable in length while the ladder is secured to the support member, the ladder being so secured to the support member that the ladder is rotatable through 360° around the support member while the ladder is secured to the support member, and the base, the support member, the platform and the ladder being separable from one another to enable the height adjustable apparatus to be dismantled for being moved from place to place.

10 Claims, 6 Drawing Figures

HEIGHT ADJUSTABLE APPARATUS

This invention relates to height adjustable apparatus and it relates more especially to height adjustable apparatus for supporting goods for a person at a desired height. The goods may be, for example, tools and building or decorating materials for a workman, packaged goods for a warehouseman, or books for a librarian.

In the building and decorating trades for example, there is a constant requirement for jobs to be done at varying heights from the ground. For example, fixing of ceiling plaster boards is done at ceiling level whilst plastering cracks in a wall is done at various heights up the wall depending upon the position of the cracks. There are a great number of differing jobs that need to be done at differing heights and there is a need for workmen to be able to support their tools and materials at the appropriate working height for each job, thereby enabling the workman to work in comfort and to avoid time wastage in constantly having to bend to floor level for tools and materials or, worse still, having to descend and ascend ladders, scaffolding or work towers for the tools and materials.

In other trades, there is also a need for height adjustable apparatus. For example, in a warehouse, a person may have difficulty in standing at the top of a ladder and removing a heavy packaged article from a shelf in a warehouse. It would be advantageous if the person could slide the heavy packaged article from the shelf in the warehouse on to a platform, which platform could later be brought down nearer to ground level and to a position convenient for the person to lift the particular packaged goods from the platform. Even in libraries there is a need for height adjustable apparatus which can provide a platform capable of being moved to various desired heights so that books can be supported or read at varying heights commensurate with the shelves in the library.

In addition to height adjustable apparatus to suit the above needs, it would be advantageous if such apparatus could be easily dismantlable so that it could easily be moved from place to place, for example transported in a car or in a van from one building site to another, or transported by members of the public from a shop to their homes.

It is an aim of the present invention to provide height adjustable apparatus which satisfies all of the above needs and which is dismantlable as well.

Accordingly, this invention provides height adjustable apparatus for supporting goods for a person at a desired height, which apparatus comprises a base, a single elongate support member which upstands from the base, a platform member which is provided on the support member at the end of the support member remote from the base, and a ladder which is secured to the support member and which affords access to the platform member, the support member being adjustable in length so that the height of the platform member above the base can be varied to that required by the person for a particular task being undertaken, the ladder being so secured to the support member that the support member is adjustable in length whilst the ladder is secured to the support member, the ladder being so secured to the support member that the ladder is rotatable through 360° around the support member whilst the ladder is secured to the support member, and the base, the support member, the platform member and the ladder being separable from one another to enable the height adjustable apparatus to be dismantled for being moved from place to place.

The support member preferably comprises a first part which is slidable inside a second part. Other types of support member may however be employed.

The support member may comprise a rack and pinion arrangement for sliding the first part in and out of the second part, the rack being formed on the first part and the pinion being formed on the second part.

The rack may advantageously comprise a plurality of separately formed interlocking sections. In this case, the separately formed interlocking sections may be produced by extruding an elongate member in the required profile of the sections and then cutting the elongate member to produce the sections.

Usually, the rack and pinion arrangement will include a handle for rotating the pinion.

The rack and pinion arrangement may include a locking device for locking the pinion to the rack.

The locking device of the rack and pinion arrangement may comprise a toothed cog which is attached to the pinion, and a spring loaded pawl which is fixed with respect to the rack and which engages in the cog to stop rotation of the cog and therefore rotation of the pinion.

The spring loaded pawl may have a finger pulling mechanism for pulling the pawl away from the cog when it is desired to rotate the pinion along the rack.

The ladder is preferably provided with a sleeve member which is secured to the support member, the sleeve member being effective to secure the ladder to the support member and to allow the 360° rotation of the ladder.

The height adjustable apparatus may include a locking device for locking the sleeve member to the rack.

The locking device may conveniently be a screw device which is screwable by hand into and out of engagement with the support member.

The ladder may be provided with roller means for facilitating the 360° rotation of the ladder.

The roller means of the ladder may be wheels or castors.

The roller means of the ladder may each be provided with a brake device for preventing unwanted movement of the roller means of the ladder.

The ladder is preferably collapsible into at least two parts to facilitate transport of the ladder from place to place.

The base of the apparatus is advantageously provided with roller means so that the apparatus can be moved to desired work places.

The roller means of the base may be wheels or castors. The same type of roller means will usually be employed for the base and the ladder. Thus, the roller means of the base are preferably each provided with a brake device for preventing unwanted movement of the roller means of the base.

The base may comprise a plurality of legs. Thus for example, the base may comprise three or four legs. Alternatively, the base may comprise a plinth member.

Where the base comprises legs, the legs are preferably individually adjustable with respect to the support member. By having the legs individually adjustable, it will be apparent that the legs can be folded by being pivotted with respect to the support member, the legs being folded to enable the apparatus to be wheeled through a doorway for example. Also, in the event that the apparatus should be located on an uneven surface such for example as rough ground or on stairs, the legs can individually be adjusted and/or pivotted to provide good stable support for the apparatus.

Preferably, the platform member is pivotable about the support member. This is particularly advantageous when the height adjustable apparatus is required to fix ceiling plaster boards in which case the platform member can be provided with a ceiling plaster board and it can be pushed back against a ceiling, even if the ceiling is not perfectly flat. The ceiling plaster boards will thus be tightly fixed against all parts of the ceiling using the apparatus of the invention and then they can be nailed, screwed or otherwise fixed in position.

Preferably, the platform member is pivotable from a horizontal position to a vertical position. This particularly facilitates the fixing of wall boards to a wall. The wall boards can be mounted on the platform member with the platform member in its horizontal position, and then the platform member can be tilted to its vertical position for pushing the wall boards against the wall prior to fixing the wall boards in position with nails, screws or other fixing means.

The platform member may be pivotable by means of any desired pivoting joint such for example as a nut and bolt joint, a ball and socket joint, or any other desired type of suitable joint.

The platform member may comprise a centre portion for receiving the goods.

In one preferred embodiment of the invention, the platform member comprises the centre portion for receiving the goods, and two pairs of telescopic arms which extend one pair from opposite sides of the centre portion and which are for supporting goods such for example as ceiling plaster boards or wall boards.

Each arm may be provided with a spring biased hooked end portion for gripping the goods.

The centre portion of the platform member may comprise a frame having a recess for receiving a removable platform.

The removable platform may be a flat platform for building materials or a tray platform for goods such as tools and books.

Embodiments of the invention will now be described solely by way of example and with reference to the accompanying drawings in which.

Figure 1:
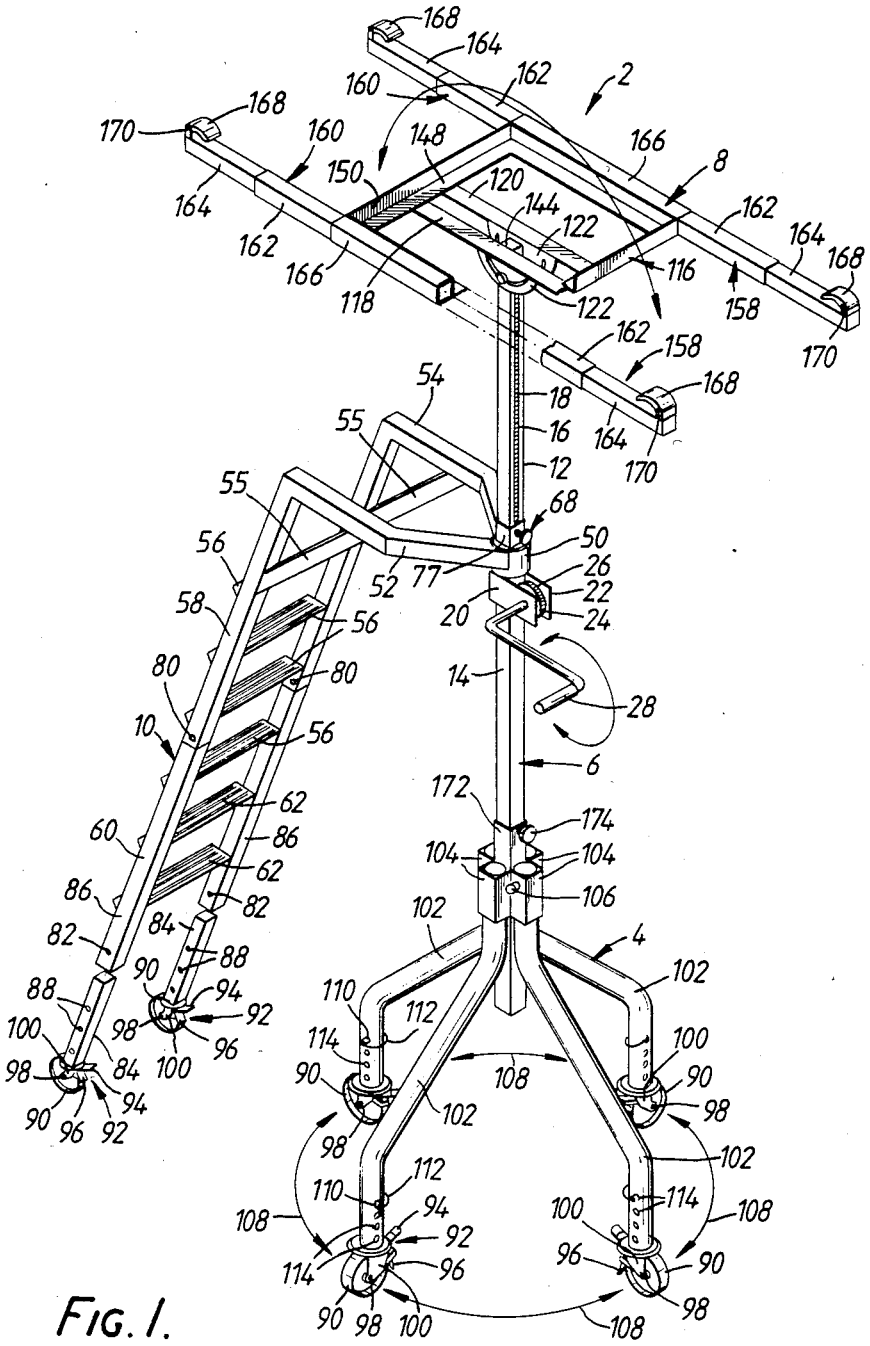
FIG. 1 shows first height adjustable apparatus in accordance with the invention.

Referring to FIGS. 1, 2, 3 and 4, there is shown height adjustable apparatus 2 for supporting goods for a person at a desired height. The apparatus 2 comprises a base 4, a single elongate support member 6 which upstands from the base 4, a platform member 8 which is provided on the support member 6 at the end of the support member 6 remote from the base 4, and a ladder 10 which is secured to the support member 6 and which affords access to the platform member 8.

As will be explained in more detail hereinbelow, the support member 6 is adjustable in length so that the height of the platform member 8 above the base 4 can be varied to that required by a person for a particular task being undertaken. Also as will be explained in detail hereinbelow, the ladder 10 is so secured to the support member 6 that the support member 6 is adjustable in length whilst the ladder 10 is secured to the support member 6. Furthermore, the ladder 10 is so secured to the support member 6 that the ladder 10 is rotatable through 360° around the support member 6 whilst the ladder 10 is secured to the support member 6.

The base 4, the support member 6, the platform member 8 and the ladder 10 are separable from one another to enable the apparatus 2 to be dismantled for being moved from place to place.

The support member 6 comprises a first part 12 which is slidable inside a second part 14. The first part 12 is of square cross section as can be seen from FIG. 2 and one side of the first part 12 is provided with a row of teeth 16 to form a rack 18. The second part 14 is also of square cross section as can be seen in FIG. 1 and a pair of plates 20, 22 are welded or otherwise secured to the second part 14. The plates support a pinion 24 having teeth 26. The pinion 24 is rotatable by a handle 28. Rotation of the handle 28 in a clockwise manner is effective to cause the teeth 16,26 to engage and the first part 12 to extend out of the second part 14, and rotation of the handle 26 in an anti clockwise manner is effective to cause the teeth 16,26 to engage and the first part 12 to descend into the second part 14.

Figure 2:
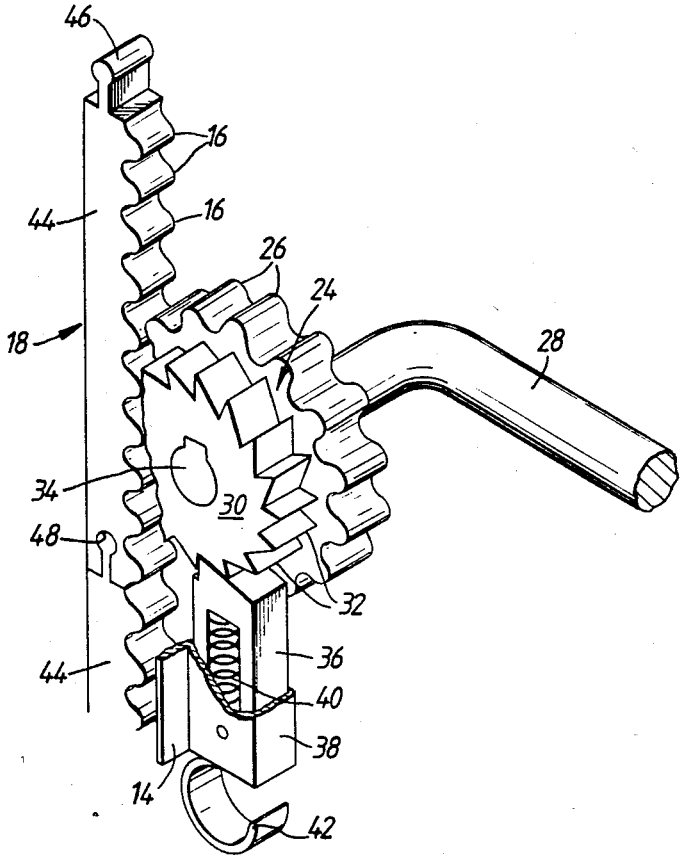
FIG. 2 shows in detail part of the height adjustable apparatus shown in FIG. 1 and includes a modification to that apparatus.

Referring now to FIG. 2, there is shown a modification of the arrangement just before described for the rack 18 and the pinion 24. In FIG. 2, it will be seen that the handle 28 is positioned on the other side of the pinion 24 as shown in FIG. 1. The free side of the pinion 24 shown in FIG. 2 is provided with a cog 30 having teeth 32. The cog 30 can be welded to the pinion 24 and or secured on a shaft 34. The cog 30 does not engage with the teeth 16 but instead engages with a pawl 36. The pawl 36 operates in a housing 38 which is secured to the second part 14 and which is shown somewhat schematically in FIG. 2. The pawl 36 is spring loaded by means of a spring 40. A finger pulling mechanism in the form of a finger hook 42 is provided. If the finger hook 42 is pulled downwardly against the pressure of the spring 40, the pawl 36 will disengage from the teeth 32 and then the pinion 24 can be rotated up or down the rack 18 by means of appropriate rotation of the handle 28. With the pawl 36 engaging the teeth 32 of the cog 30, it will be apparent that the pinion 24 cannot be rotated.

FIG. 1 illustrates that the rack 18 is formed as a single elongate member. In contrast, in FIG. 2 it will be seen that the rack 18 is formed of a plurality of separate rack sections 44. As many sections as desired, for example seven sections, may be employed to make a single rack 18. It will be seen that each rack section 44 has at one end a knob 46 and at the other end a complementary recess 48. The rack sections 44 thus slot together. The rack sections 44 can advantageously be made by extruding a single length of material having the profile of a single rack section 44. The extruded length of material can then be transversely cut to form a plurality of rack sections of the width shown in FIG. 2. Due to difficulties in extrusion, the rack sections 44 will usually not be much longer than about 17 mm.

Referring back now mainly to FIG. 1, it will be seen that the ladder 10 is provided with a sleeve member 50. The sleeve member 50 is formed at the end of a pair of arms 52,54 which extend transversely from the top of the ladder 10 as shown. A pair of bracing members 56 is provided for strengthening the arms 52,54 the members each extending between a side of the ladder 10 and one of the arms 52,54.

The ladder 10 comprises a plurality of rungs 56 and it will be seen that the ladder is in two sections 58. The rungs 56 are in the form of flat treads and their upper surface 62 is grooved as shown to provide a good grip. The ladder 10 can be dismantled into the two sections 58,60 for ease of transport and storage.

Figure 3:
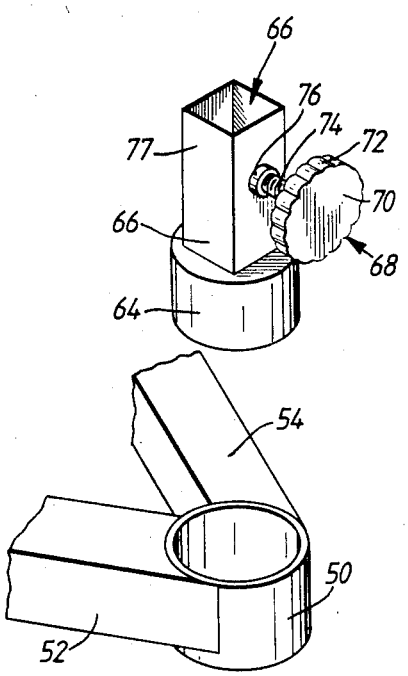
FIG. 3 illustrates in detail part of the apparatus shown in FIG. 1.

As shown in FIG. 3, the sleeve member 50 fits over a bearing 64. The bearing 64 has a square hole 66 which enables the bearing 64 to fit over the square lower end of the first part 12. The sleeve member 50 can rotate about the bearing 64 through 360° so that the ladder 10 can rotate entirely around the support member 6. This is particularly advantageous because the ladder 10 can then be arranged at any desired angle with respect to the platform member 8 and this can be very important, for example when securing ceiling plaster boards to a ceiling.

FIG. 3 also shows that the bearing 64 includes a locking device in the form of a hand screw 68. The hand screw 68 has a knob 70 which has a ribbed periphery 72 as shown and a screw threaded shank 74. The shank 74 passes through a boss 76 formed on the outside of a bearing extension piece 77. The shank 74 extends through the boss 76 and through the extension piece 77 and engages between the teeth 16 of the rack 18. In this position, the extension piece 77 (and therefore the bearing 64, the sleeve member 50 and the ladder 10) are locked in position on the rack 18. The ladder 10 can however still rotate through the 360° about the bearing 64.

In use, the ladder 10 will be extended to a desired height by being manually pushed upwardly. This means that the sleeve member 50, the bearing 64 in the sleeve member 50, and the extension piece 77 are all pushed up the rack 18. The ladder 10 can then be ascended and the friction of the sleeve member 50, the bearing 64 and the extension piece 77 against the first part 12 will stop the ladder 10 from sliding down. For safety however, the knob 70 can then be rotated such that the shank 74 extends through the boss 76 and the extension piece 77, and between the teeth 16 on the rack 18. The ladder 10 then cannot collapse downwardly. Obviously, when it is desired to lower the ladder 10, the knob 70 is just undone. For most uses of the apparatus 2, the length of the ladder 10 will be chosen such that in its position as illustrated in FIG. 1, a person can work satisfactorily on the ladder 10 without having to extend the ladder up the first part 12. It will only be for the minority of jobs that it is necessary to extend the ladder 10 up the first part 12.

It will be seen from FIG. 1 that the two sections 58,60 of the ladder 10 can be secured together by pins 80. The bottom part of the section 60 is provided with apertures 82 for receiving further pins (not shown) for locking arms 84 inside the sides 86 of the section 60, the pins passing through the apertures 82 and into one of three registering apertures 88 in the arms 84. The arms 84 terminate in roller means in the form of wheels 90. The wheels 90 facilitate the 360° rotation of the ladder.

Each wheel 90 is provided with a brake device 92 for stopping rotation of the wheel and thus preventing unwanted movement. The brake devices 92 each comprise an upper lever 94 and a brake portion 96 which can be moved into and out of engagement with the periphery of the wheels 90 to lock the wheels 90 into position. The wheels 90 pivot about pivots 98 which are supported on arms 100 as shown.

FIG. 1 illustrates that the base 4 comprises four legs 102. As shown, each leg 102 has its upper end provided in a separate housing 104. Each housing 104 is shown as being of square cross section and each housing 104 has a locking pin 106 for locking each leg 102 in position in its housing 104. With the locking pin 106 undone, each leg can pivot in its housing 104 so that the legs 102 can pivot towards or away from one another as shown by the arrows 108. Normally the legs in their position shown in FIG. 1 may be too wide to pass through a small doorway. The locking pin 106 can thus be released and the legs 102 pivoted towards one another to reduce the overal width of the base 4 and thus to enable the apparatus 2 in its assembled condition to be wheeled through a small doorway.

Another advantageous feature of having the legs 102 movable in their housings 104, is that each leg 102 can be moved up and down in its housing 104. This is possible because the part of each leg 102 in the housing 104 is provided with several apertures (not shown but like the apertures 88) for engaging as appropriate with the pin 106. The vertical movement of the legs 102 is advantageous where the legs 102 are mounted on rough ground or on different stairs of a stairway. A good firm base is afforded by pivoting and/or moving the legs 102 up and down.

The legs 102 are provided with roller means in the form of wheels. These wheels are the same as the wheels 90 used for the ladder 10 and so similar parts have been given the same reference numerals. The wheels 90 will usually have arms which are of circular cross section to go in the lower ends of the legs 102. The arms (not shown) will have apertures that are the same as the apertures 88 shown in FIG. 1 for the wheels 90 of the ladder 10. The legs 102 are provided with locking pins 110 which are held in position by wires 112 so that the pins 110 cannot get lost. The pins 110 pass through apertures 114 in the legs 102 as shown and into the apertures in the arms inside the legs 102.

Figure 4:
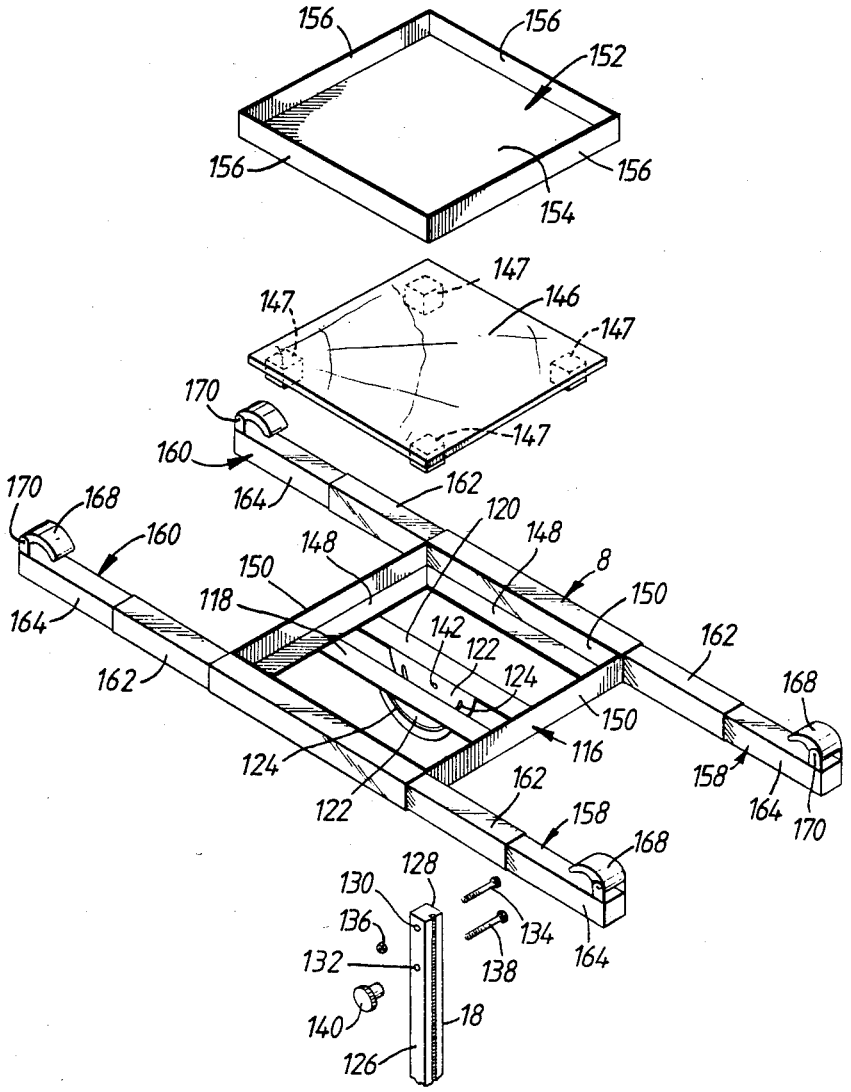
FIG. 4 illustrates in detail part of the apparatus shown in FIG. 1.

Referring to FIGS. 1 and 4, it will be seen that the platform member 8 is pivotable about the top of the rack 18. More specifically, the platform member 8 comprises a centre portion 116 which is made of angle iron as shown, see especially FIG. 1 where part of the centre portion 116 has been broken away for clarity of illustration. The centre portion 116 has a pair of strengthening arms 118,120. The arms 118 and 120 are each provided with a downwardly depending half circular plate 122. Each plate 122 is provided with a half circular slot 124 as shown. The plates 122 pass on either side 126, 128 of the top of the rack 18. The top of the rack 18 is provided with a pair of holes 130,132 as shown in FIG. 4. The hole 130 receives a bolt 134 which is held in position by a nut 136. The hole 132 receives a bolt 138 which receives a thumb tightenable nut 140. The bolt 134 is a pivot bolt about which the platform member 8 pivots, the bolt 134 also passing through holes 142 in the plates 122. The bolt 138 acts as a locking bolt and it slides in the slots 124. When the platform member 8 has been pivoted to a desired angle with respect to the top of the rack 18, then the nut 140 can be tightened by hand to lock the platform member in its desired position. As the nut, 140 is tightened, the plates 122 bear against the sides 126,128 of the top 144 of the rack 18 so that the plates 122 do not become distorted.

The platform member 8 is such that the centre portion 116 defines a recess formed by the angle iron for receiving a movable platform. FIG. 4 shows a first removable platform 146 which has four corner blocks 147. The platform 146 sits on the blocks 147 in the recess on the bottom arms 148 of the angle iron. The top surface of the platform 146 then extends proud of the top of the arms 150 and the platform 146 can be used for cement, plaster or similar materials.

FIG. 4 also shows another removable platform in the form of a tray 152 having a base 154 and upstanding side walls 156. If the tray 152 is placed with the base 154 on the arms 148, then the tray 152 can be used to hold tools and other articles.

FIGS. 1 and 4 further illustrate how the centre portion 116 is provided with two pairs of telescopic arms 158,160. Each telescopic arm 158, 160 comprises a first part 162 which is fixed to the centre portion 116 and a second part 164 which slides in and out of the first part 162. It will be seen that the two pairs of telescopic arms 158,160 extend from opposite sides of the centre portion 116 and they are for supporting boards such for example as ceiling plaster boards or wall boards. The arms are extended to an appropriate length and they can be spring biased towards a closed position, for example by a coil spring housed inside the portion 166 attached to opposing sides of the centre portion 116 as shown.

The ends of the second parts 164 of the arms 158, 160 terminate in spring biased hooked end portions 168 as shown. Each hooked end portion 168 pivots about a pivot pin 170 and is pulled by a spring (not shown) towards its closed position adjacent its second part 164. In this position, the hooked end portions 168 are effective to grip the ends of wall or ceiling boards (not shown).

FIG. 1 also illustrates how the second part 14 of the support member 6 fits into a holder 172 formed as a centre part of the housings 104. The second part 14 is locked in a desired position by a hand operable screw 174. With the screw 174 undone, the second part 14 can be pulled out of the holder 172 so that the platform member 8 can be separated from the base 4. By pulling the first part 12 clear of the sleeve member 50, the sleeve member 50 can be removed from the support member 6 to separate the ladder 10 from the support member 6. By undoing the nuts 136,40 and removing the bolts 134,138, the platform member 8 can be removed from the top of the support member 6. Thus, the base 4, the support member 6, the platform member 8 and the ladder 10 are all separable from each other for easy dismantling, transport and storage.

Figure 5:
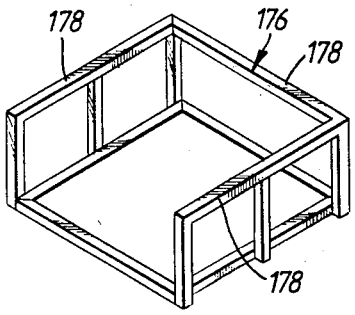
FIG. 5 shows an accessory for use with the apparatus of FIG. 1.

FIG. 5 shows a basket 176 with upstanding open frame sides 178 as shown. The basket 176 can be arranged to slot into the centre portion 116 of the platform member 8 to rest on the arms 148. A base such as the removable platform 146 can be provided to close the bottom of the basket 176 or the basket 176 can be provided with an integrally formed base. The basket 176 can then be suitable for holding large and bulky goods. The basket 176 may thus be useful in a warehouse where a warehouseman is able to put heavy and/or bulky goods into the basket at a high level, then lower the platform 8 to a lower level and then remove the goods from the basket 176 whilst standing on the ground, as opposed to balancing on a ladder and descending the ladder with the goods as presently often has to be done.

Figure 6:
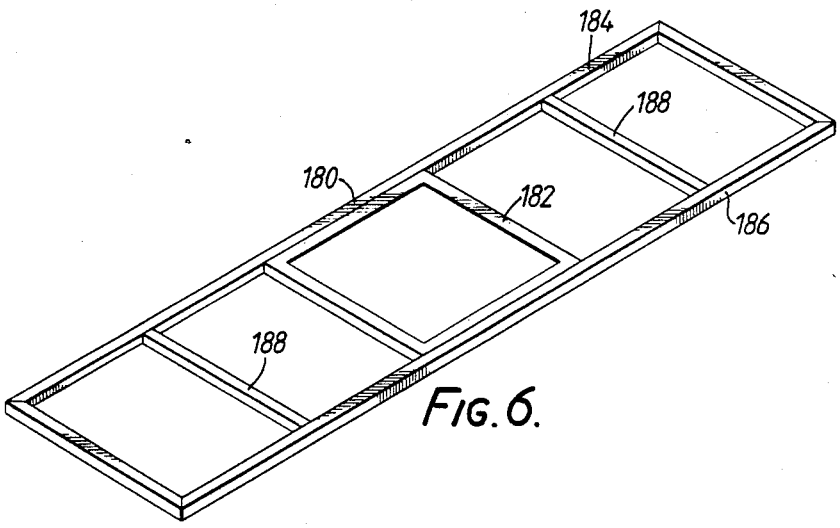
FIG. 6 shows another accessory for use with the apparatus of FIG. 1.

Referring now to FIG. 6, there is shown another type of platform accessory 180 that is of use for heavy goods such for example as shop signs, which may be too heavy for the telescopic arms 148. The platform accessory 180 has a centre portion 182 which fits over the tray 152 when the tray 152 is turned upside down from the position shown in FIG. 4 and inserted into the centre portion 116 so that the sides 156 rest on the arms 148. Clips or other fixing means (not shown) can then be used to secure the platform accessory 180 and the tray 152 to the centre portion 116. The entire platform accessory 180 will then extend from either side of the centre portion 116 and can firmly support heavy loads. If necessary, boards can be laid across the platform accessory 180 to rest on the cross members 188.

The apparatus 2 can be made from any desired materials such for example as aluminium or steel.

It is to be appreciated that the embodiments of the invention described above with reference to the accompanying drawings have been given by way of example only and that modifications may be effected. Thus, for example, the height of the ladder 10 may be made such that it is the correct height for substantially all intended uses of the apparatus 2 so that it is then not necessary for the ladder 10 to have a sleeve member 50 that slides up and down the first part 12. In this case, a simple bearing 64 can be used and the extension piece 77 and its associated hand screw 68 can be omitted.

If the platform member 8 is lowered right down, it may be desired to work above the platform member 8 and in this case, the lower section 60 of the ladder 10 can be removed and, if desired, the arms 84 with their associated wheels 90 can be inserted up the sides of the upper section 58 and secured in position by a pin passing through the apertures 80 in the sides of the section 58.

If desired, a foot plate (not shown) may be provided for the comfort of a person standing on the ladder 10. The foot plate will usually hook over a desired rung 62 of the ladder 10.

As an alternative to employing the illustrated rack and pinion device 18,24, the first part 12 may be arranged to slide in and out of the second part 14 and to be secured in position by a pin passing through one of a series of holes in the first part 12.

The bearing 64 is shown as being made of a solid material such for example as brass or nylon. If desired, however, the bearing 64 may be a roller bearing or a needle bearing.

The locking device in the form of the hand screw 68 can in an alternative embodiment of the invention be arranged to operate on indentations on one of the sides 126,128 of the second part 12, instead of operating on the teeth 16 of the rack 18.

The apparatus 2 can advantageously be provided with a spirit level. The spirit level can be located where desired on the apparatus 2, for example on the platform member 8. Although any type of spirit level may be employed, a circular spirit level is preferred since it occupies only a small amount of space.

The apparatus 2 is advantageously provided with an emergency operating device in the event that the handle 28 should become broken. The emergency operating device may be a nut which is provided on the plate 22 opposite the end of the handle 28. The nut engages with the pinion 24 so that rotation of the nut, for example by a spanner, rotates the pinion 24.

We claim:

1. Height adjustable apparatus for supporting goods for a person at a desired height, which apparatus comprises a base, a single elongate support member which upstands from the base, a platform member which is provided on the support member at the end of the support member remote from the base, and a ladder which is secured to the support member and which affords access to the platform member, the support member being adjustable in length so that the height of the platform member above the base can be varied to that required by a person for a particular task being undertaken, the ladder being so secured to the support member that the support member is adjustable in length whilst the ladder is secured to the support member, the ladder being so secured to the support member that the ladder is rotatable through 360° around the support member whilst the ladder is secured to the support member, and the base, the support member, the platform and the ladder being separable from one another to enable the height adjustable apparatus to be dismantled for being moved from place to place.

2. Height adjustable apparatus according to claim 1 in which the support member comprises a first part which is slidable inside a second part, and in which the support member also comprises a rack and pinion arrangement for sliding the first part in and out of the second part, the rack being formed on the first part, the pinion being formed on the second part, and the rack comprising a plurality of separately formed interlocking sections.

3. Height adjustable apparatus according to claim 2 in which the rack and pinion arrangement includes a locking device for locking the pinion to the rack.

4. Height adjustable apparatus according to claim 1 in which the ladder is provided with a sleeve member which is secured to the support member, the sleeve member being effected to secure the ladder to the support member and to allow the 360° rotation of the ladder.

5. Height adjustable apparatus according to claim 4 and including a locking device for locking the sleeve member to the rack.

6. Height adjustable apparatus according to claim 4 in which the ladder is provided with roller means for facilitating the 360° rotation of the ladder, and in which the base is provided with roller means so that the apparatus can be moved to desired work places.

7. Height adjustable apparatus according to claim 6 in which the ladder is collapsible into at least two parts to facilitate transport of the ladder from place to place.

8. Height adjustable apparatus according to claim 1 in which the base comprises a plurality of legs which are individually adjustable with respect to the support member.

9. Height adjustable apparatus according to claim 1 in which the platform member is pivotable about the support member.

10. Height adjustable apparatus according to claim 9 in which the platform member comprises a centre portion for receiving the goods, and two pairs of telescopic arms which extend one pair from opposite sides of the centre portion and which are for supporting boards.

* * * * *